US006667449B2

(12) United States Patent
Wecke et al.

(10) Patent No.: US 6,667,449 B2
(45) Date of Patent: Dec. 23, 2003

(54) SWITCH HINGE

(75) Inventors: Rolf Wecke, Bückeburg (DE); Joachim Ulfik, Vlotho (DE); Achim Hoffmann, Minden (DE)

(73) Assignee: Bernstein AG, Porta Westfalica (DE)

( * ) Notice: Subject to any disclaimer, the term of this patent is extended or adjusted under 35 U.S.C. 154(b) by 5 days.

(21) Appl. No.: 10/086,843

(22) Filed: Mar. 4, 2002

(65) Prior Publication Data

US 2002/0125116 A1 Sep. 12, 2002

(30) Foreign Application Priority Data

Mar. 6, 2001 (DE) ..... 201 03 850 U

(51) Int. Cl.[7] ..... H01H 3/16

(52) U.S. Cl. ..... 200/61.7; 200/19.03; 200/61.81; 340/545

(58) Field of Search ..... 200/61.7, 61.72, 200/61.73, 61.74, 61.76, 61.81, 61.82, 19.03, 19.2; 340/545, 549, 556, 600, 686

(56) References Cited

U.S. PATENT DOCUMENTS

| | | | | |
|---|---|---|---|---|
| 4,049,934 A | | 9/1977 | Newlon | |
| 4,168,409 A | * | 9/1979 | McNinch | 200/61.7 |
| 4,284,861 A | * | 8/1981 | Senften | 200/61.7 |
| 4,841,283 A | * | 6/1989 | Bubliewicz | 340/545 |
| 4,922,064 A | * | 5/1990 | Price et al. | 200/61.7 |

FOREIGN PATENT DOCUMENTS

| | | |
|---|---|---|
| DE | 199 02 919 A1 | 8/2000 |
| EP | 0 304 241 A2 | 8/1988 |
| GB | 1 333 034 | 10/1973 |

* cited by examiner

*Primary Examiner*—Lincoln Donovan
*Assistant Examiner*—K. Lee
(74) *Attorney, Agent, or Firm*—Barnes & Thornburg

(57) ABSTRACT

A switch hinge is described having a first hinge wing, which accommodates a switch operable by a lever, having a second hinge wing and having a shaft which, in the operative position, is non-rotatably connected with the second hinge wing. The shaft, on its circumference, has a switch groove which extends in the direction of the shaft axis and into which an operating pin connected with the lever dips in a predetermined swivelling position between the two hinge wings. In a preassembled condition, in which the operating pin rests in the switch groove, the shaft is secured by a lock against rotation with respect to the first hinge wing, and the second hinge wing is freely swivellably with respect to the shaft. A screw screwed into the face-side end of the first hinge wing axially displaces the shaft by a predetermined extent out of the preassembled position into the operative position. The shaft has a knurled or otherwise structured ring zone which, when the shaft is displaced in the operative position, is press fitted into a hinge bore of the second hinge wing, for achieving the securing against rotation between the second hinge wing and the shaft. Subsequently, the rotational lock of the shaft to the first hinge wing is removed.

8 Claims, 2 Drawing Sheets

SWITCH HINGE

BACKGROUND AND SUMMARY OF THE INVENTION

The present invention relates to a switch hinge having a first hinge wing, which accommodates a switch operable by a lever, having a second hinge wing and having a shaft. The shaft, in the operative position, is non-rotatably connected with the second hinge wing and, on its circumference, has a switch groove which extends in the direction of the shaft axis and into which an operating pin connected with the lever dips in a predetermined swivelling position between the two hinge wings. The lever extends parallel to the longitudinal axis of the shaft and is swivellable with respect to the shaft as well as being loaded by a spring in the direction of the shaft and being situated in the region of a control cam or control pin of the switch.

Switch hinges of the above-mentioned type are known per se and are used, for example, as hinges for protective hoods on machines, shelter doors or the like. In this case, the overall construction of a switch hinge is designed such that the on-position of the switch exists only when the protective hood or the shelter door is closed. In this situation, the operating pin connected with the lever engages in the switch groove of the shaft.

When the protective hood or shelter door is now opened up, a resulting rotation of the shaft has the effect that the operating pin is pressed out of the switch groove and is supported on the outer circumference of the shaft. This, in turn, results in a lever operation and thus in an operation of the control cam or of the control pin of the switch, so that the switch is changed into its off-position.

Because of the many different installation situations for switch hinges of the above-mentioned type occurring in practice, it must be ensured that the reaching of the on-position for the switch will always only be possible when a protective hood or shelter door takes up its closed position. In this case, these closed positions may definitely result in many different mutual angular positions of the two hinge wings. For this reason, switch hinges of the above-mentioned type had so far in each case been manufactured according to order instructions.

It is an object of the present invention to provide a switch hinge of the above-mentioned type which can be used universally and can be adapted to every conceivable application case.

According to the invention, this object is achieved in that, in a preassembled condition, in which the operating pin rests in the switch groove, the shaft is secured by a lock against rotation with respect to the first hinge wing, and the second hinge wing is freely swivellably with respect to the shaft. By means of a fitting screw screwed into the face-side end of the first hinge wing, the shaft can be axially displaced by a predetermined extent out of the preassembled position into the operative position. The shaft is provided with a knurled or otherwise structured ring zone which, when the shaft is displaced in the operative position, is press fitted into a hinge bore of the second hinge wing, for achieving the securing against rotation between the second hinge wing and the shaft.

A switch hinge designed in this manner has considerable advantages in practice. Independently of the later concrete usage case, such a switch hinge can be assembled at the factory in its preassembled position. This switch hinge can now be fastened at the site, for example, to a stationary machine part and a protective cover movable with respect to the latter. In each case, the operating pin of the lever rests in the switch groove of the shaft, whereby the on-position of the switch is defined. In this case, it is not important which angular position the two hinge wings take up relative to one another because, in this preassembled position, the second hinge wing is still freely rotatable with respect to the shaft.

After the connection of the switch hinge according to the connection, in the closed position of a protective hood or of a shelter door, the shaft is now axially displaced by the fitting screw into its operative position. In this case, the knurled or otherwise structured ring zone, while achieving a form closure, is pressed into the hinge bore of the second hinge half. Now, a swivelling of the second hinge wing relative to the shaft is not longer possible. Next, the securing, with respect to rotation, by a lock is eliminated between the first hinge wing and the shaft, and the hinge can be operated. An opening of the protective hood or of a shelter door now has the result that the shaft is rotated with respect to the first hinge wing and, as a result, the operating pin connected with the lever is moved out of the switch groove. Thus, as mentioned above, the switch takes up its off position.

A hinge switch according to the invention can therefore be used universally and, in practice, can be adjusted without any problem for any conceivable application case.

Additional characteristics of the invention are described.

Other aspects of the present invention will become apparent from the following detailed description of the invention, when considered in conjunction with accompanying drawings.

DETAILED DESCRIPTION OF THE PREFERRED EMBODIMENTS

Figure 2:
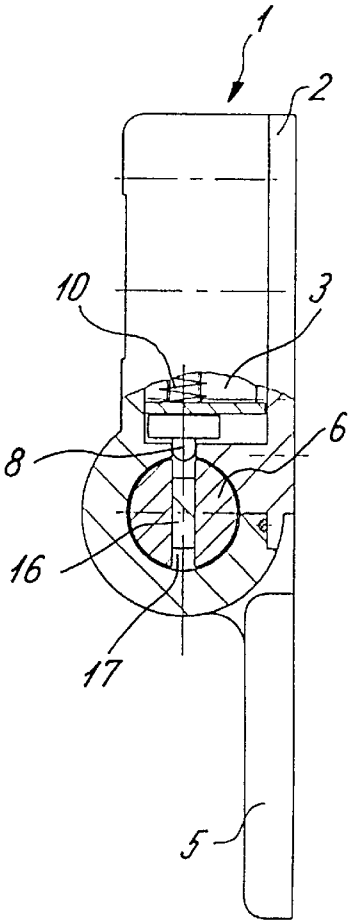
FIG. 2: A partially sectional view in the direction of the arrow II of FIG. 1.

The switch hinge, which is illustrated in FIGS. 1 to 4 and, as a whole, has the reference number 1, has a first hinge wing 2 with a hollow chamber 3, inside which a switch 4 is arranged.

Furthermore, the switch hinge 1 has a second hinge wing 5 and a shaft 6, by way of which the two hinge wings 2 and 5 are connected with one another.

In its circumferential region, the shaft 6 has a switch groove 7 (see FIG. 1), into which an operating pin 8 can dip when the shaft 6 takes up a certain rotating position relative to the first hinge wing 2.

The above-mentioned operating pin 8 is connected with a lever 9 which extends parallel to the longitudinal axis of the shaft 6 and can be swivelled with respect to the shaft 6. In addition, the lever 9 is loaded by a spring 10 which continuously acts upon the lever 9 in the direction of the shaft 6.

The lever 9 is situated in the area of a control cam or control pin 11 of the switch 4 and can therefore operate this control cam or control pin 11.

The shaft 6 is disposed at an end in a hinge bore 12 of the first hinge wing 2 and at its other end is disposed in a receiving bore 13 of a fitting screw 14 which is screwed into a face-side end of the first hinge wing 2. In addition, the shaft 6 penetrates the second hinge wing 5 in the area of a hinge bore 15.

Figure 1:
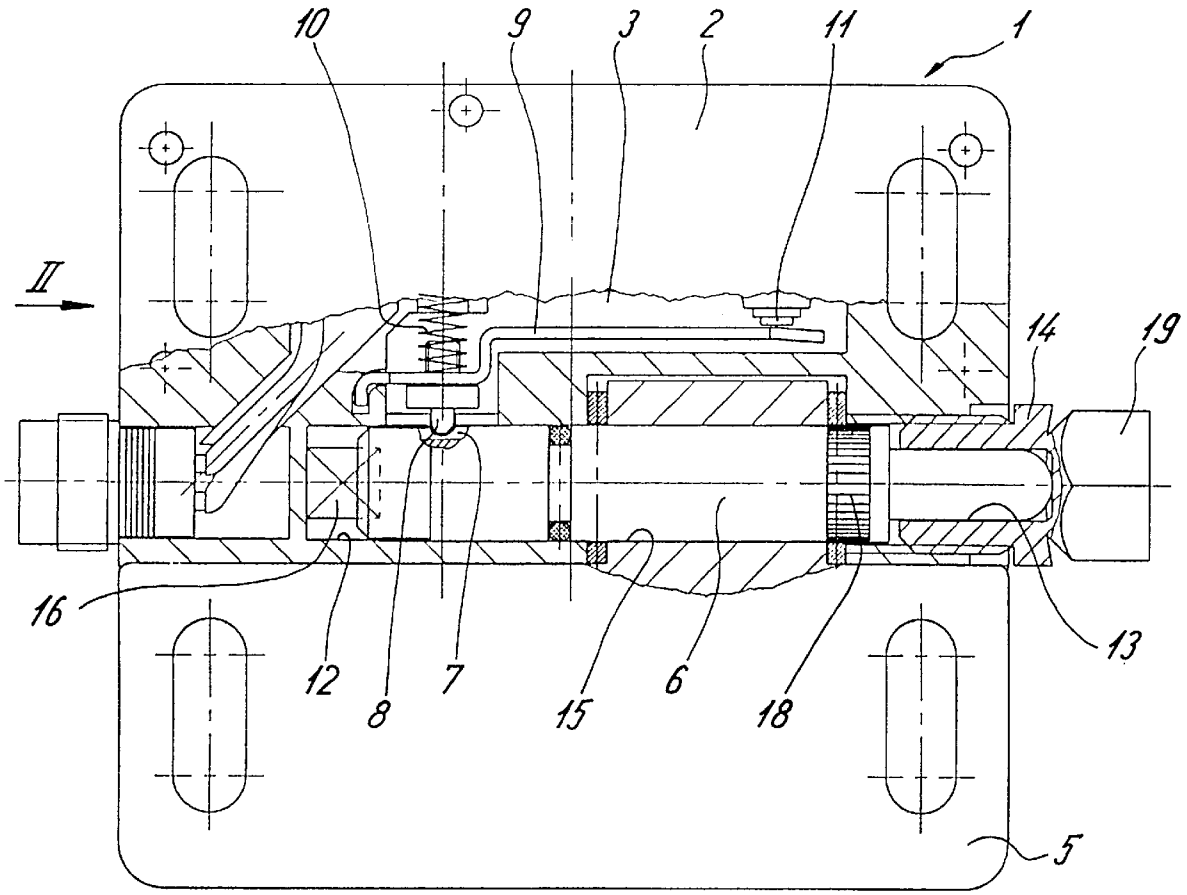
FIG. 1: A partially sectional top view of a switch hinge according to the invention in the preassembled position.
Figure 4:
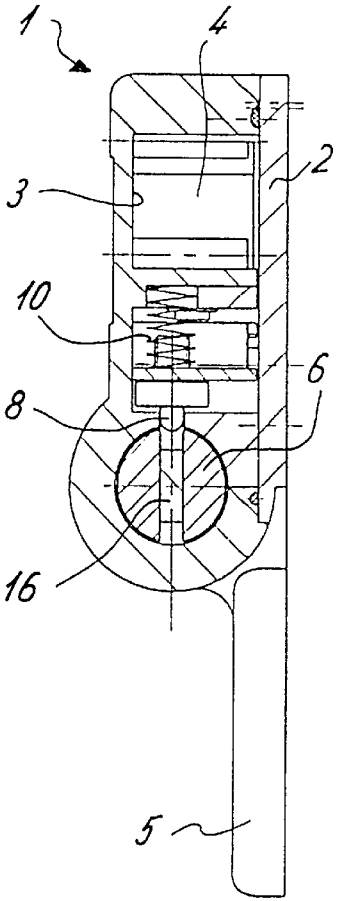
FIG. 4: A partially sectional view in the direction of the arrow IV of FIG. 3.

In the preassembled position illustrated in FIG. 1, the operating pin 8 rests in the switch groove 7 of the shaft 6. In this preassembled position, the shaft 6 is secured rotationally to the first hinge wing 2 by a lock. Specifically in the illustrated embodiment, the lock is a polygonal pin 16 which is fixedly connected with the hinge wing 2 and which rests in a front-side slot 17 of the shaft 6.

In the above-mentioned preassembled position according to FIG. 1, the second hinge wing 5 is still freely rotatable with respect to the shaft 6.

The shaft 6 is provided with a knurled (or otherwise structured) ring zone 18 which is situated in the preassembled position according to FIG. 1 still outside the hinge bore 15 of the second hinge wing 5.

Figure 3:
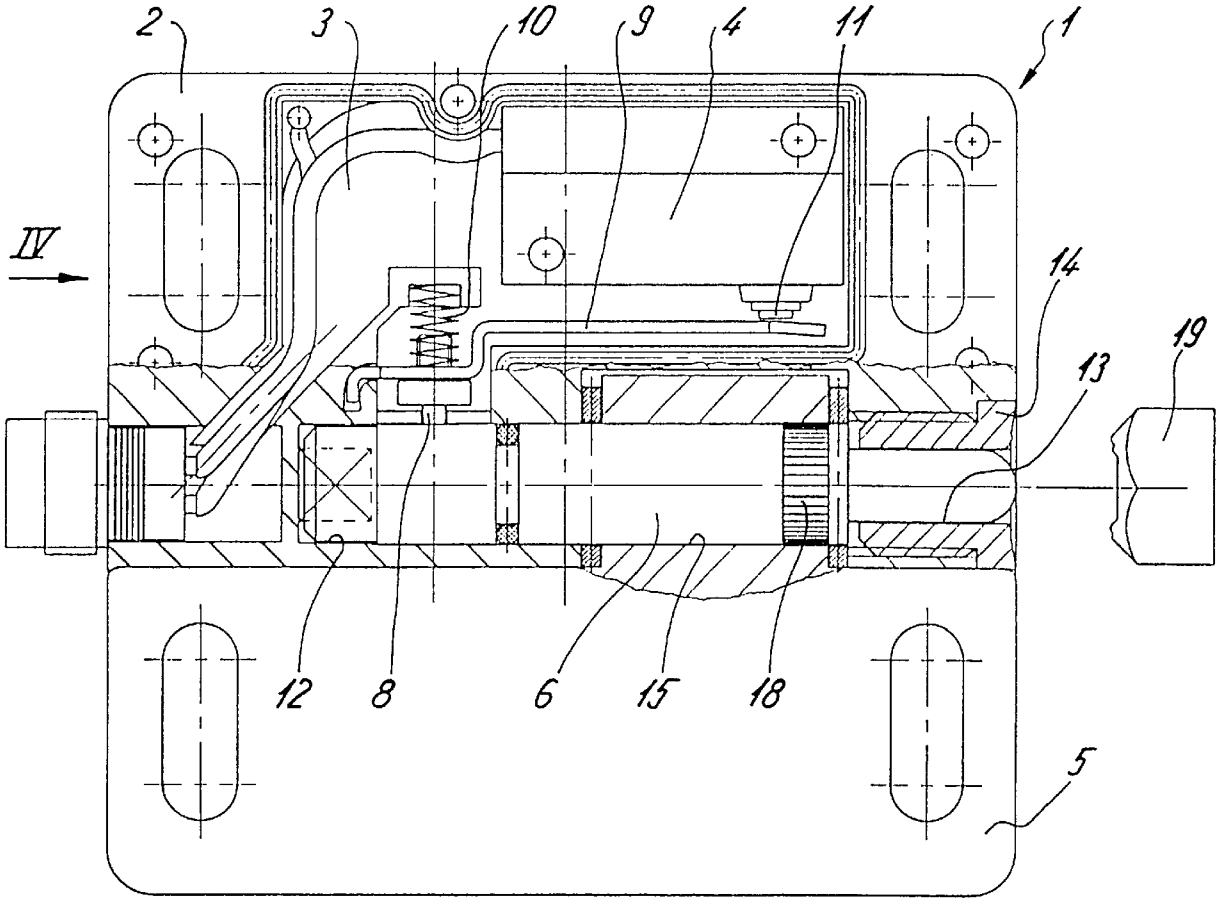
FIG. 3: A partially sectional top view of the switch hinge in the operative position corresponding to FIG. 1.

Before the final operating position according to FIG. 3 is established, the hinge wing 5 can now be moved into an arbitrary swivelling position relative to the hinge wing 2, without any resulting change of the position between the shaft 6 and the first hinge wing 2. When the desired operating position of the second hinge wing 5 has been reached (corresponding to the closed position, for example, of a protective hood), the shaft 6 can be axially displaced by operating the fitting screw 14, whereby a knurled or otherwise structure ring zone 18, while achieving a form closure, is pressed into the hinge bore 15 of the second hinge wing 5. The shaft 6 is surface-hardened at least in the area of the ring zone 18. After this final assembled position according to FIG. 3 has been reached, the screw head 19 of the fitting screwed 14 can be sheared off, as clearly illustrated in FIG. 3.

A swivelling of the second hinge wing 5 relative to the first hinge wing 2 shears-off the polygonal pin 16. The torque which can be transferred between the knurled ring zone 18 of the shaft 6 and the hinge bore 15 of the second hinge wing 5 is selected to be several times greater than the torque required for the shearing-off of the polygonal pin 16 with respect to the first hinge wing 2 and breaking the lock.

After the shearing-off of the polygonal pin 16, the switch hinge is now ready to operate to an unlimited degree and it is easily ensured that the operating pin 8 rests into the switch groove 7 when the preset swivelling position of the second hinge wing 5 with respect to the first hinge wing 2 has been reached—corresponding to the closed position, for example, of a protective hood.

The shaft 6 is surface-hardened in the area of its knurled or otherwise structured ring zone 18, whereby, on the one hand, the form-locking pressing into the hinge bore 15 is facilitated and, on the other hand, the achieved form closure is ensured on a long-term basis.

Deviating from the illustrated embodiment, a lock temporarily securing against a rotation between the shaft 6 and the first hinge wing 2 would be possible, for example, by a pin which is pushed in through a bore within the first hinge wing 2 into a transverse bore of the shaft 6. This pin could then be removed after the establishment of the final operating position. Optionally, a sealing-off of the bore by the first hinge wing 2 would also make sense.

As an alternative to the mechanically operated switch illustrated in the embodiment, the switch hinge according to the invention can naturally also be equipped with optically, inductively, capacitively or magnetically acting sensors for sensing the movement of the lever 9. For increasing the safety stage, a combination of various sensors can also be used.

This type of a solution is considered to be equivalent to the use of a mechanical switch.

Although the present invention has been described and illustrated in detail, it is to be clearly understood that this is done by way of illustration and example only and is not to be taken by way of limitation. The spirit and scope of the present invention are to be limited only by the terms of the appended claims.

What is claimed is:

1. A switch hinge comprising:

a first hinge wing which accommodates a switch operable by a lever;

a second hinge wing;

a shaft which, in the operative position, is non-rotatably connected with the second hinge wing, the shaft, on its circumference, has a switch groove into which an operating pin connected with the lever dips in a predetermined swivelling position between the two hinge wings;

in a preassembled condition, in which the operating pin rests in the switch groove, a lock securing the shaft against rotation with respect to the first hinge wing, and the second hinge wing is freely swivellably with respect to the shaft;

a fitting screw screwed into a face-side end of the first hinge wing axially displaces the shaft by a predetermined extent out of the preassembled position into an operative position; and the shaft having a knurled or otherwise structured ring zone which, when the shaft is displaced in the operative position, is press fitted into a hinge bore of the second hinge wing, for achieving the securing against rotation between the second hinge wing and the shaft.

2. The switch hinge according to claim 1, wherein the lock for a securing against a rotation between the first hinge wing and the shaft in the preassembled position includes a polygonal pin which is connected with the first hinge wing, engages a slot in the end of the shaft and can be sheared off.

3. The switch hinge according to claim 2, wherein the torque, which can be transmitted between the shaft and the second hinge wing in the area of the ring zone form-lockingly pressed into the hinge bore of the second hinge wing, is several times greater that the torque required for shearing off the polygonal pin.

4. The switch hinge according to claim 1, wherein the shaft is surface-hardened at least in the area of its knurled or otherwise structured ring zone.

5. The switch hinge according to claim 1, wherein the fitting screw includes a screw head which can be sheared off.

6. The switch hinge according to claim 1, wherein the lever extends parallel to a longitudinal axis of the shaft and is swivellable with respect to the shaft as well as being loaded by a spring in the direction of the shaft and is situated in the region of a control cam or control pin of the switch.

7. The switch hinge according to claim 1, wherein the lock is a pin extending into a transverse bore in the shaft.

8. The switch hinge according to claim 1, wherein the lock is removed after the hinge is in the operative position.

* * * * *